United States Patent [19]

Leveckis et al.

[11] 4,196,331

[45] Apr. 1, 1980

[54] MICROWAVE ENERGY COOKING BAG

[75] Inventors: Algis S. Leveckis, Ludlow, Ky.; Gerald August, Palo Alto, Calif.

[73] Assignee: The Procter & Gamble Company, Cincinnati, Ohio

[21] Appl. No.: 925,598

[22] Filed: Jul. 17, 1978

[51] Int. Cl.[2] ..... H05B 9/06; A21D 10/02

[52] U.S. Cl. ..... 219/10.55 E; 229/3.5 MF; 426/107

[58] Field of Search ..... 219/10.55 E, 10.55 M, 219/10.55 R; 426/107, 113, 124, 234, 241, 243, 392, 396, 412; 229/3.5 MF; 99/451; 220/450; 126/390

[56] References Cited

U.S. PATENT DOCUMENTS

| | | | |
|---|---|---|---|
| 3,410,700 | 11/1968 | Gstohl | 426/107 |
| 3,490,580 | 1/1970 | Brumfield et al. | 219/10.55 E X |
| 3,615,711 | 10/1971 | Markus | 426/107 X |
| 3,851,574 | 12/1974 | Katz et al. | 426/107 |
| 3,873,735 | 3/1975 | Chalin et al. | 426/107 X |
| 4,015,085 | 3/1977 | Woods | 219/10.55 E |
| 4,038,425 | 7/1977 | Brandberg et al. | 426/107 |
| 4,144,438 | 3/1979 | Gelman et al. | 219/10.55 E |

*Primary Examiner*—Arthur T. Grimley
*Attorney, Agent, or Firm*—Thomas J. Slone; Fredrick H. Braun; Richard C. Witte

[57] ABSTRACT

An improved cooking bag in which, for instance, food can be uniformly cooked by microwave energy in a microwave oven without having to adjust the level of power or stir or reposition the food as is now commonly practiced due to microwave energy being unevenly distributed in contemporary microwave cooking apparatus. The improved bag is of the type having microwave energy moderating wall portions which comprise arrays of complemental-shape microwave reflective areas of electrically conductive material such as aluminum foil, and substantially microwave transparent areas. The bag is improved by having relatively low density, high bulk electrically insulative material disposed adjacent electrically conductive areas to sufficiently electrically insulate or space them to substantially obviate electrical arcing which arcing can, under some circumstances, occur intermediate such areas, and intermediate such areas and adjacent electrically conductive materials: for instance, metal components of a microwave oven and/or metal components or portions of other such bags or other cookware.

9 Claims, 13 Drawing Figures

MICROWAVE ENERGY COOKING BAG

DESCRIPTION

1. Technical Field

This invention relates to microwave energy cooking bags which are employed to contain material to be heated or cooked with microwave energy.

Microwave energy fields used for cooking are commonly not uniform in intensity. Cooking foodstuffs in non-uniform microwave energy fields precipitates non-uniform doneness. Microwave energy fields can be moderated to make them substantially more uniform than when not moderated. The microwave energy cooking bag provided by the present invention so moderates an otherwise non-uniform field of microwave energy that substantially uniform cooking is precipitated therein.

2. Background Art

A microwave energy moderating bag is disclosed and claimed in the copending U.S. patent application Ser. No. 854,941 which was filed on Nov. 25, 1977, and which is hereby incorporated by reference. Such a bag comprises electrically conductive material, such as a sheet of aluminum foil which foil may, under some circumstances, precipitate spontaneous electrical arcing when disposed in a microwave energy field. The tendency to so precipitate arcing is also believed to be aggravated by closely spacing and poorly insulating electrically conductive members or portions of members with respect to other electrically conductive members/portions.

Some embodiments of microwave energy moderating bags and various details thereof are shown in FIGS. 14 through 16 and FIGS. 33 through 48 of the above referenced copending application. Briefly, as compared to those bag constructions, the present invention is an improved microwave energy cooking bag which comprises sufficient relatively low density, high bulk electrically insulative material (eg; low dielectric loss thermoplastic) disposed between adjacent face-to-face areas of electrically conductive sheet materials in the bag so that electrical arcing intermediate such face-to-face areas is substantially obviated. The improved bag may further comprise additional such high bulk insulative material (eg; a batt or sheet) disposed externally with respect to the electrically conductive sheet material. In addition to providing improved arc resistance by way of insulating and spacing electrically conductive materials from each other, such a batt is desirably sufficiently thick and resilient with respect to the dead-fold property of the electrically conductive sheet material to substantially preclude folding the bag in such a manner that would precipitate sharp creases. In turn, this obviates high intensity fields which would otherwise be induced adjacent such sharp creases.

An improved microwave energy moderating cooking bag of the general type described in the above referenced copending application is also disclosed and claimed in the copending U.S. patent application Ser. No. 896,421 which was filed Apr. 14, 1978 by Algis S. Leveckis and Stephanie S. Gelman. The Leveckis et al. improved bag comprises perforate electrically conductive sheet material and is so configured that adjacent side-by-side edge segments of the electrical conductive sheet material are sufficiently offset with respect to each other to virtually obviate edge-to-edge electric field relations therebetween.

The prior art further discloses a number of microwave cooking containers and the like which comprise selective shielding and/or microwave transparent apertures of various sizes in structures that are otherwise microwave reflective. For instance, U.S. Pat. No. 3,547,661 which issued Dec. 15, 1970 to P. N. Stevenson discloses a container and food heating method wherein apertures of various sizes are provided in the top and bottom and are in registered relation. Such apertures may also be partially masked by microwave reflective material as indicated in FIGS. 1 and 3, areas 25 through 28. The various sizes of apertures and partial masking ostensibly provide means for selectively heating different items to different temperatures simultaneously; reference Abstract Of The Disclosure. U.S. Pat. No. 4,013,798 which issued Mar. 22, 1977 to Costas E. Goltsos also discloses a selectively shielded microwave cooking structure comprising registered openings of various sizes.

The contemporary use of apertures of various sizes and/or shapes which are disposed in the top of a microwave cooking food tray which is otherwise microwave reflective are disclosed in U.S. Pat. No. 3,672,916 which issued June 27, 1972 to H. J. Virnig, and in U.S. Pat. No. 3,219,460, which issued Nov. 23, 1965 to E. Brown.

Pothier et al., U.S. Pat. No. 3,865,301 (issued Feb. 11, 1975), disclose a Partially Shielded Food Package For Dielectric Heating for exposing a plurality of food articles therein differentially to microwave radiation. Pothier et al. disclose rounding of corners and spacing of edges of microwave conductive portions of such a package to reduce charing and arcing. However, as compared to the present invention, the conductive sheets of Pothier et el. containers are imperforate, do not expressly comprise resilient high bulk insulative/-spacer materials, and are not fully electrically insulated. Moreover, Pothier et al. teach differentially heating enclosed articles whereas the present invention is directed to achieving uniform cooking by establishing uniform microwave energy fields.

Additionally, while it is not believed to be prior art with respect to this invention, R. V. Decareau, Ph.D., has disclosed that perforated end caps can be used to protect the ends of otherwise unshielded, relatively long cylindrical roasts from overcooking in a microwave oven; Reference 1977 International Microwave Power Symposium Summaries, Minneapolis, Minnesota, May 24–27, 1977.

To summarize the prior art, some of the problems associated with microwave cooking have been solved in part by prior art developments. However, it is believed that the prior art has not addressed providing such things as materials-efficient high bulk materials as means for electrically insulating and spacing electrically conductive portions of microwave energy moderating cooking bags, nor providing means in such bags for substantially precluding creasing and/or crumpling which would aggravate their susceptibility to spontaneously arcing in microwave energy fields.

DISCLOSURE OF THE INVENTION

In accordance with one aspect of the present invention, an improved microwave energy cooking bag is provided which bag is of the type having microwave energy moderating wall portions and in which such wall portions include perforate electrically conductive sheet materials having some face-to-face areas. The improvement comprises materials-efficient high-bulk spacing and electrical insulation means for substantially obviating electrical arcing which arcing can, under some circumstances, occur intermediate adjacent such face-to-face areas of said electrically conductive sheet material. Such means may comprise a batt of a relatively low density, relatively low dielectric loss factor, relatively high electric field strength electrically insulative thermoplastic material disposed intermediate adjacent face-to-face areas of electrically conductive sheet material. Such materials may include generic polyolefins, polypropylene, polyethylene, fluorocarbons, polyimids, polyesters, polysulfones, and polycarbonates. The improved bag may further comprise additional such insulative thermoplastic material which is so configured and disposed with respect to the electrically conductive sheet material of the bag that electrical arcing is substantially obviated intermediate the bag and adjacent electrically conductive material. Such materials also desirable have sufficient resilience that their presence in the bag structure provides means for substantially obviating creasing and/or crumpling of the electrically conductive sheet materials in the bag inasmuch as sharp creases and/or crumpling would tend to increase the probability that such bags would, under some circumstances, precipitate electrical arcing when said bag is disposed in a field of microwave energy. Such batts may include thermoplastic foams having cellular structures, as well as nonwoven thermoplastic webs, embossed thermoplastic webs, laminated thermoplastic structures comprising sealed air chambers, cellulosic materials, and the like.

BRIEF DESCRIPTION OF THE DRAWINGS

While the claims hereof particularly point out and distinctly claim the subject matter regarded as forming the present invention, it is believed the invention will be better understood in view of the following detailed description of the invention taken in conjunction with the accompanying drawings in which corresponding features of the several views are identically designated, and in which:

DETAILED DESCRIPTION OF THE INVENTION

Figure 1:
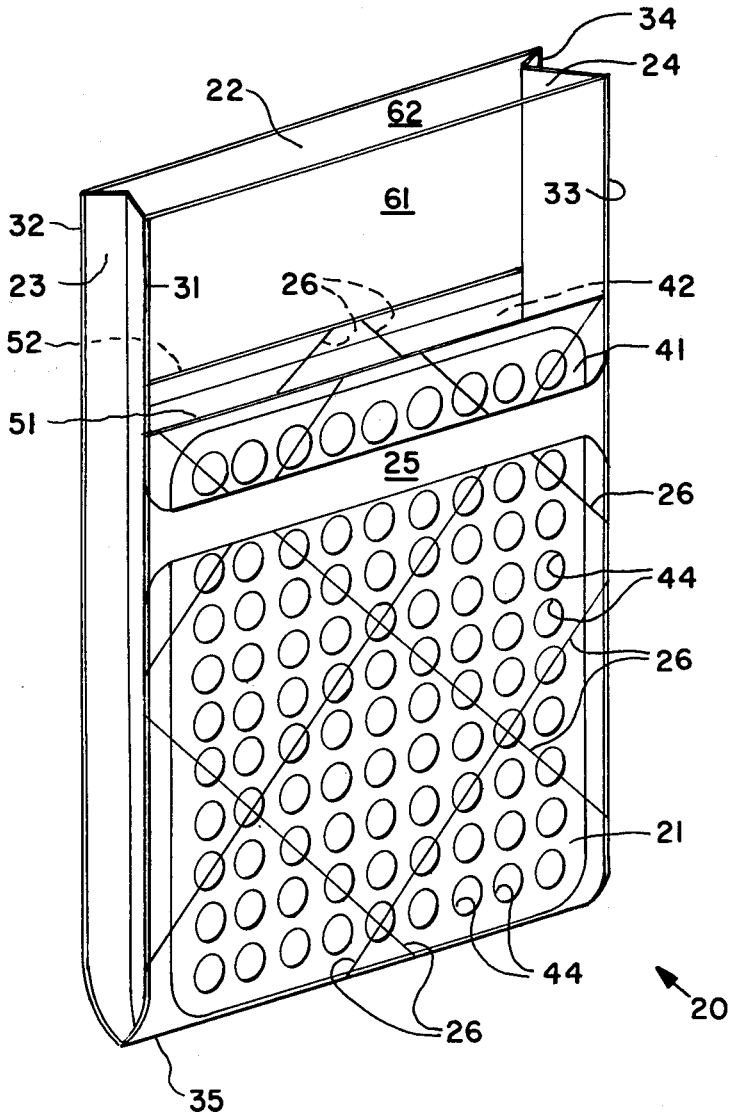
FIG. 1 is a perspective view of a jumbo size microwave energy moderating cooking bag embodiment of the invention.

An exemplary, laminated, microwave energy cooking bag 20 is shown in perspective in FIG. 1. Bag 20 is fabricated from a laminated front panel 21, a laminated back panel 22, side gusset panels 23 and 24, and a closure strap 25. Panels 21 through 24 are heat sealed together to form seams 31, 32, 33, 34, and 35. The strap 25, is secured transverse the front panel by having its ends integrally heat welded along segments of seams 31 and 33. Further structural integrity for bag 20 is provided by a quilt-like network of bar-shape heat seals 26 in the front panel 21 and in the back panel 22.

Briefly, the front panel 21 and the back panel 22 comprise electrically conductive sheets 41 and 42, respectively, which have rounded corners and are perforated by a predetermined array of apertures 44. For example, sheets 41 and 42 may be one mil thick aluminum foil. Panels 21 and 22 further comprise sheets, batts, or webs of relatively high bulk electrically insulative material on both sides of the electrically conductive sheets 41 and 42. The portions of panels 21 and 22 which extend above the sheets 41 and 42 provide, in combination with strap 25, means for nonsealingly closing the top end of the bag 20 by folding and tucking the extended portions under strap 25. Thus constructed, bag 20 comprises materials-efficient means for sufficiently moderating an otherwise non-uniform field of microwave energy that foodstuff disposed therein can be uniformly cooked in, for instance, a microwave oven without having to periodically turn or reposition the food; without having to change the power level of the microwave energy field; and without having to first defrost frozen foodstuffs.

As used herein, materials-efficient is defined as using materials in such a manner as to achieve given parametric performance factors with less material than would be otherwise required. For instance, in the present invention, the use of high bulk thermoplastic materials such as foamed polypropylene achieves greater insulative spacing per gram of material per square inch of conductive sheet than non-high-bulk materials. Moreover, the high bulk insulative material also provides relatively greater resiliency and thus greater crease and crumpling protection to conductive sheets such as sheets 41 and 42 in bag 20.

Still referring to FIG. 1, a transverse seam 51 extends horizontally across the front of bag 20. Seam 51 is also shown in FIG. 1 to be in the front panel 21 of bag 20, and a corresponding seam 52 is disposed in the back panel 22 at the same elevation as seam 51. The portion of front panel 21 disposed above seam 51 is designated flap 61 and the portion of back panel 22 disposed above seam 52 is designated flap 62.

Figure 2:
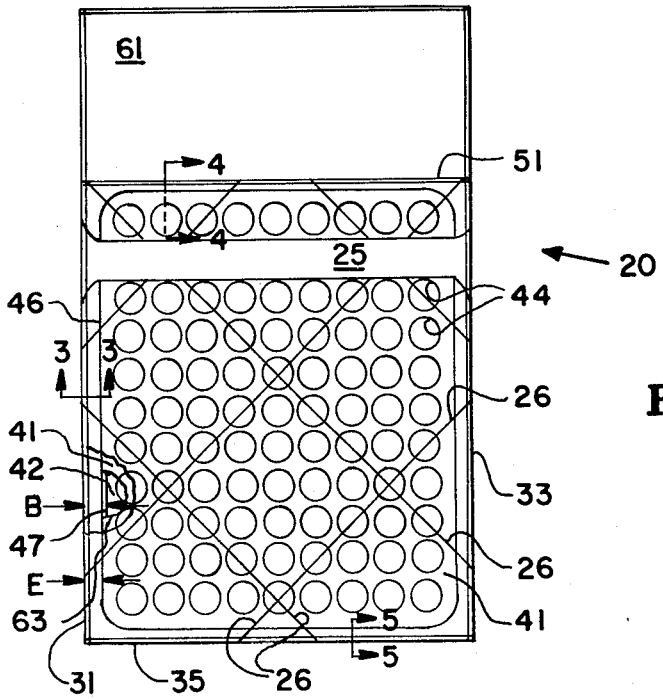
FIG. 2 is a reduced scale, partially torn away, frontal view of the microwave energy cooking bag shown in FIG. 1.

FIG. 2 is a reduced scale frontal view of bag 20, FIG. 1, in which portions are torn away to show that the left edge 46 of sheet 41 in front panel 21 is spaced a distance E from the left edge (seam 31) of the bag 20, and that the left edge 47 of sheet 42 in back panel 22 is spaced a distance B from the left edge of bag 20. Thus, the left edge 46 of sheet 41 is offset or spaced from the left edge 47 of sheet 42. This offset edge relation is maintained about the entire perimeters of sheets 41 and 42. The offset edge relation is provided to substantially reduce the intensity of electric fields which would otherwise form adjacent side-by-side but not offset edges of electrically conductive materials when disposed in a field of microwave energy. In practice an offset (distance B less distance E) of about six millimeters has been found to provide a significant reduction in field intensities. Of course, greater offsets of adjacent edges would further reduce the intensity of such fields but would necessarily reduce the microwave energy shielding/moderation capability of the sheet 47 because of its concomitant reduced overall size.

Tear line 63, FIG. 2, through an aperture 44 in sheet 41 also shows that the apertures 44 in sheets 41 and 42 are in registration although such registration is not believed to be critical to the present invention.

The remainder of the construction of front panel 21 and back panel 22 will be better understood from the descriptions of the enlarged scale, fragmentary sectional views 3 through 5 which views are taken along lines 3—3 through 5—5, respectively, of bag 20, FIG. 2. Thicknesses are exaggerated in these views for clarity inasmuch as the preferred materials of construction are too thin to be clearly shown in true scale.

Figure 3:
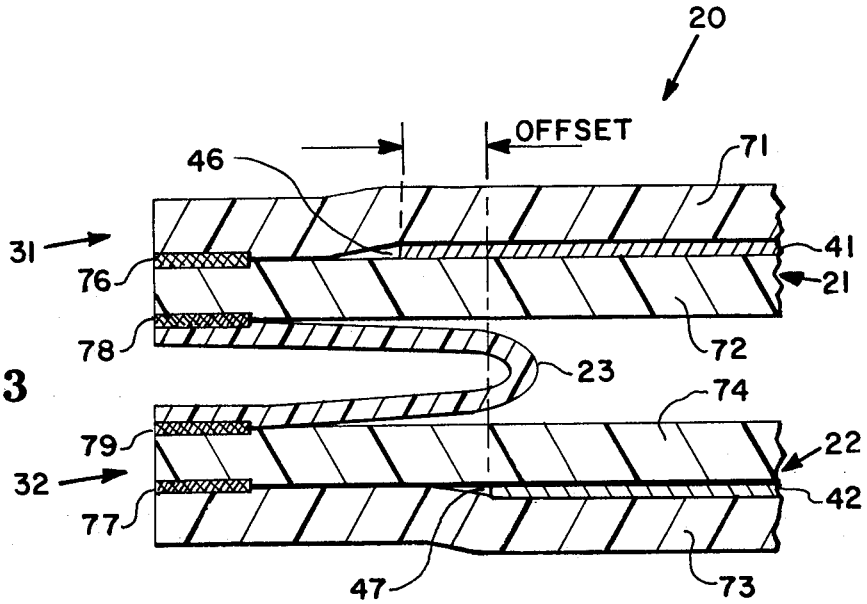
FIGS. 3 through 5 are enlarged scale, fragmentary sectional views taken along lines 3—3, 4—4, and 5—5, respectively, of FIG. 2, and in which views thicknesses are greatly exaggerated for clarity.

FIG. 3 shows the multi-layer construction of front panel 21 and back panel 22, seams 31 and 32, and gusset panel 23 which details are identically identified in either FIG. 1 or FIG. 2 or both.

Front panel 21, FIG. 3, comprises sheet 41, and two sheets or batts or layers 71 and 72 of a relatively high bulk, low dielectric loss, thermoplastic material which is substantially transparent to microwave energy; for instance, foamed polypropylene such as Microfoam (registered trademark of E. I. DuPont Co.) which is available in various nominal thicknesses. Similarly, back panel 22, FIG. 3, comprises a sheet 42, and two batts or layers 73 and 74. Bar seals 76, and 77 are provided to edge seal the front panel 21 and back panel 22, respectively. Similarly, bar seals 78 and 79 are provided to secure gusset panel 23 to the front panel 21 and back panel 22, respectively.

Figure 4:
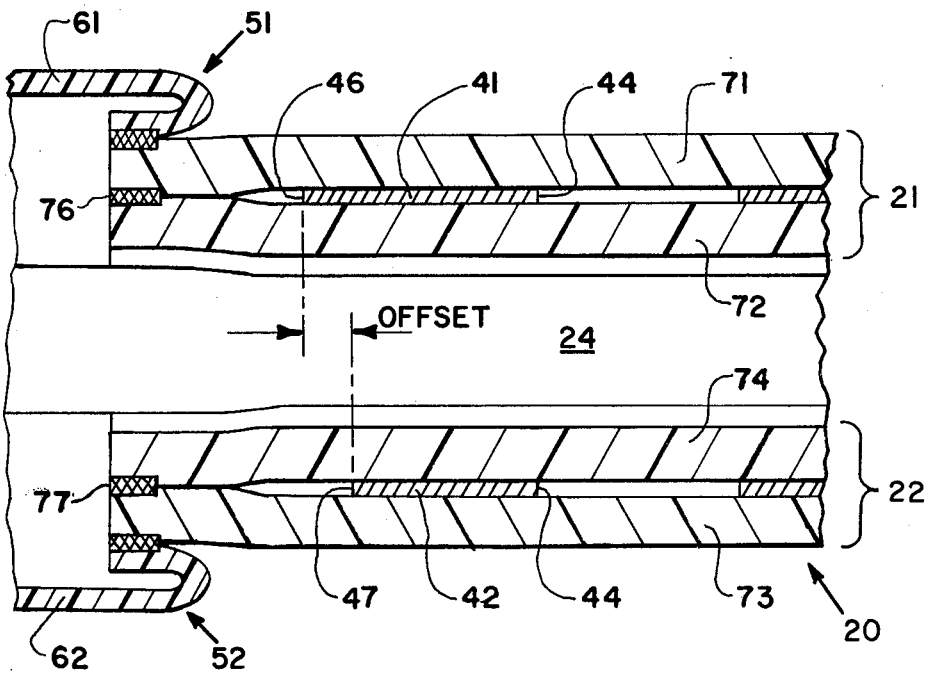

FIG. 4 shows the construction details of bag 20 in the region where flaps 61 and 62 are secured to the layered portions of panels 21 and 22 along seams 51 and 52, respectively.

Figure 5:
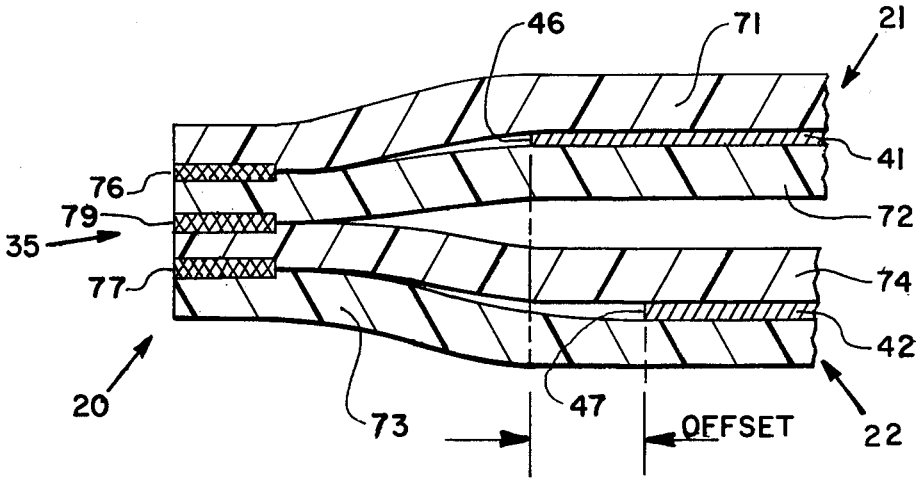
Figure 6:
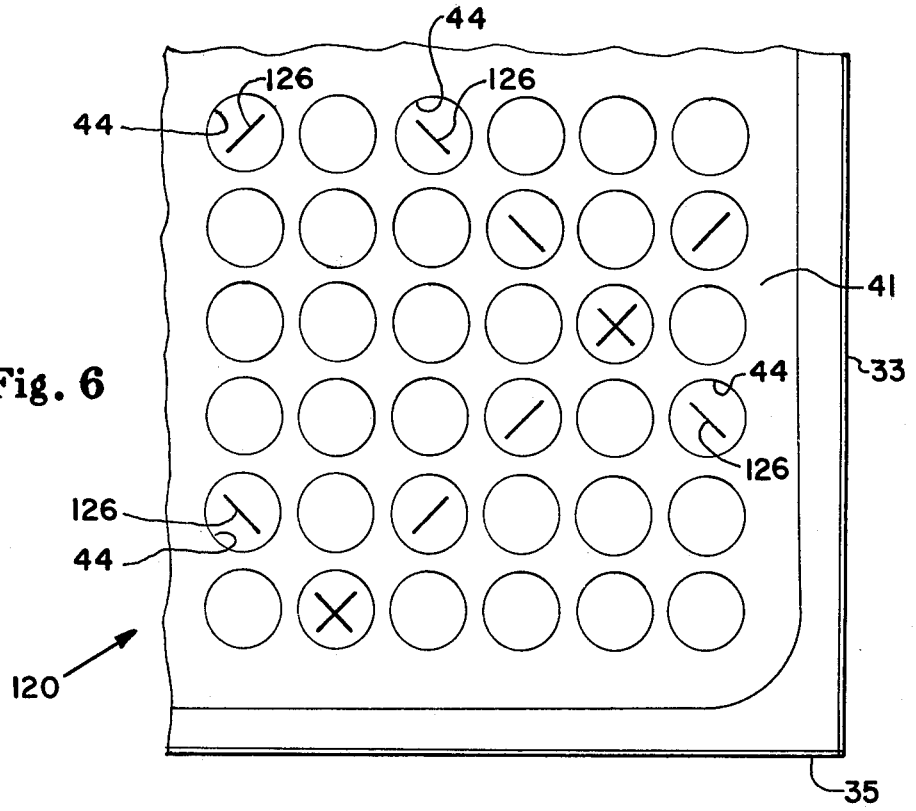
FIGS. 6 through 9 are, relative to FIGS. 1 and 2, enlarged scale, fragmentary frontal views of alternate bag embodiments of the present invention.
Figure 7:
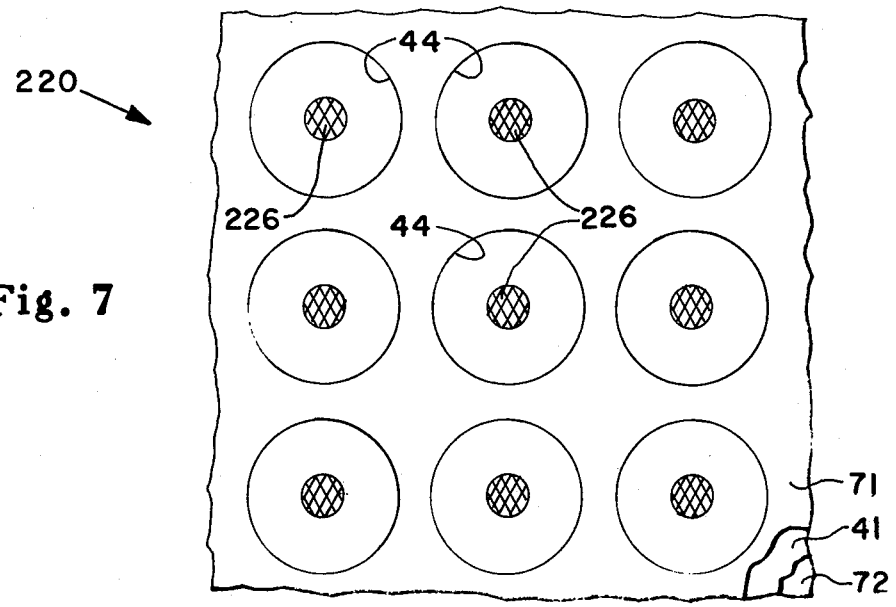
Figure 8:
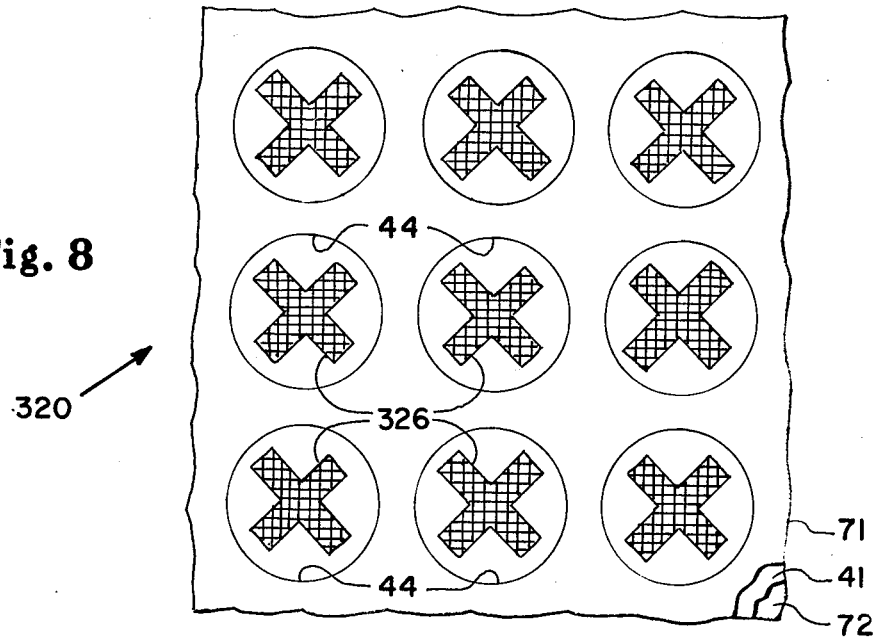
Figure 9:
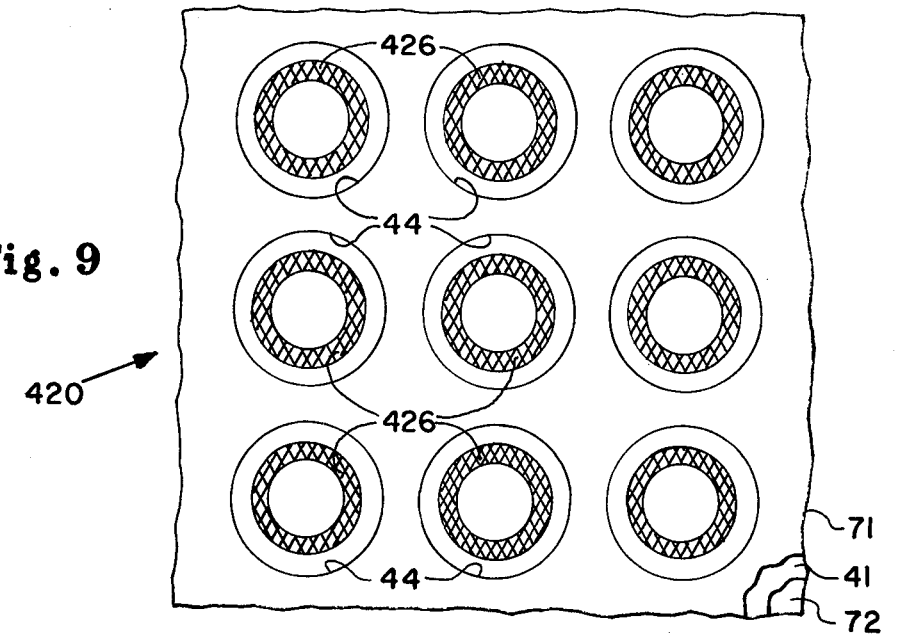

FIG. 5 shows the construction of bottom seam 35 of bag 20. As described hereinabove, bar seals 76 and 77 edge seal the front panel 21 and back panel 22, respectively, and seal 79 secures the bottom edge of front panel 21 to the bottom edge of back panel 22.

Bag 20 is constructed by first fabricating front panel 21, back panel 22, gusset panels 23 and 24, and strap 25 as discrete members. Then, these members are integrated into a finished bag by bar sealing the members together as shown in FIG. 1.

More specifically, front panel 21 is fabricated by first forming a three layer subassembly by sandwiching a prepunched, precontoured sheet 41 of, for instance, aluminum foil intermediate two batts of relatively high bulk, low dielectric loss thermoplastic material which is substantially transparent to microwave energy. The batts are sufficiently large that their edges extend beyond the edges of sheet 41. The batts and sheet 41 are then secured together in face-to-face relation by a quilt-like network of bar seals 26, FIG. 1, which extend diagonally across spaced diagonal rows of apertures 44. Where these bar seals extend across apertures 44, bar seals 26 secure the two batts directly together. A thinner batt for forming flap 61 of relative low dielectric loss material is then bar sealed to the above described three layer subassembly; this forms bar seal 51, FIGS. 1 and 4. Front panel 21 is then completed by bar sealing and hot wire cutting its top, side, and bottom edges. Gusset panels 23 and 24 and strap 25 are attached simultaneously as the side edges of panel 21 are bar sealed and trimmed. Panel 22 is made and attached to gusset panels 23 and 24 in the same manner as panel 21. Bag 20 is completed by bar sealing the bottom edges of the panels 21 and 22 and U-folded lower edge portions of gusset panels 23 and 24 together to form bottom seam 35, FIG. 1.

An exemplary embodiment of bag 20, FIGS. 1 through 5, comprises sheets 41 and 42 of one mil aluminum foil which have rounded corners and offset edges, and are perforated by an orthogonal array of eleven rows of nine apertures 44 (total ninety-nine apertures 44). Apertures 44 are perferably about twenty-five millimeters in diameter and are spaced about thirty-one millimeters center-to-center.

Batts 71 through 74, FIGS. 3 through 5, of the exemplary bag 20 are foamed polypropylene such as described hereinbefore. This material, when procured, has a nominal thickness of about three-quarters-millimeter (one-thirty-second-inch). It is then calendared intermediate hot rolls having surface temperatures of about two-hundred-seventy-five degrees fahrenheit and under a pressure of about eighty pounds per square inch (80 psi) to reduce its nominal thickness by about one-half to about three-eighths-millimeter (0.015 inch). Moreover, when procured, the commercial foamed polypropylene has a nominal density of about one-hundredth gram per cubic centimeter (0.01 g./cc), and a surface coefficient of friction of about one-and-four-tenths (1.4). The above calendaring increases the nominal density by about fifty percent to about fifteen-thousandths gram per cubic centimeter (0.015 g/cc), and decreases the nominal surface coefficient of friction to about one (1). The decreased coefficient of friction makes it easier, for instance, for a user of a bag 20 to slide a cooking vessel into and out of a bag 20.

Gusset panels 23 and 24 and flaps 61 and 62 of the exemplary bag 20 are fabricated from the commercially available foamed polypropylene described hereinabove. However, to make flaps 61 and 62, the foamed polypropylene is calendared to a nominal thickness of about one-tenth-millimeter (four-thousandths of an inch). The calendaring also renders the polypropylene slick to the feel, and satin-like in appearance.

Overall, the exemplary bag 20 described above has a nominal width of about thirty-four (34) centimeters, and a nominal total length of about fifty-three (53) centimeters. Gusset panels 23 and 24 have nominal widths of about seven (7) centimeters.

To use a bag 20 for its intended purpose a user would, for instance, place foodstuff in a microwave oven safe cooking vessel. The vessel is then slipped into the bag 20. Of course, some foodstuffs such as potatoes are suitable for being placed directly into a cooking bag 20. The bag is closed but not sealed by folding its top portion forwardly along seams 51 and 52 and tucking the distal end of the top portion under strap 25, FIG. 1. The loaded bag may then be placed in a microwave oven so that sheets 41 and 42 are substantially perpendicular to the incident microwave energy to which it will be exposed. In most contemporary microwave ovens this will have the bag disposed so that sheets 41 and 42 are substantially horizontal.

FIGS. 6 through 9 are enlarged scale fragmentary portions of alternate bag embodiments 120, 220, 320, and 420 of the present invention wherein, rather than having bar seals 26 as shown in FIGS. 1 and 2, the three layer front and back panels of the bags are each joined together in face-to-face relation only in the portions of the thermoplastic batts spanning apertures 44. In bag 120, FIG. 6, spaced bar seals 126 are provided in spaced apertures 44; in bag 220, FIG. 7, spot seal 226 is provided in each aperture 44; in bag 320, FIG. 8, a cross-shape bar seal 326 is provided in each aperture 44; and in bag 420, FIG. 9, an annular-shape bar seal 426 is provided in each aperture 44.

Figure 10:
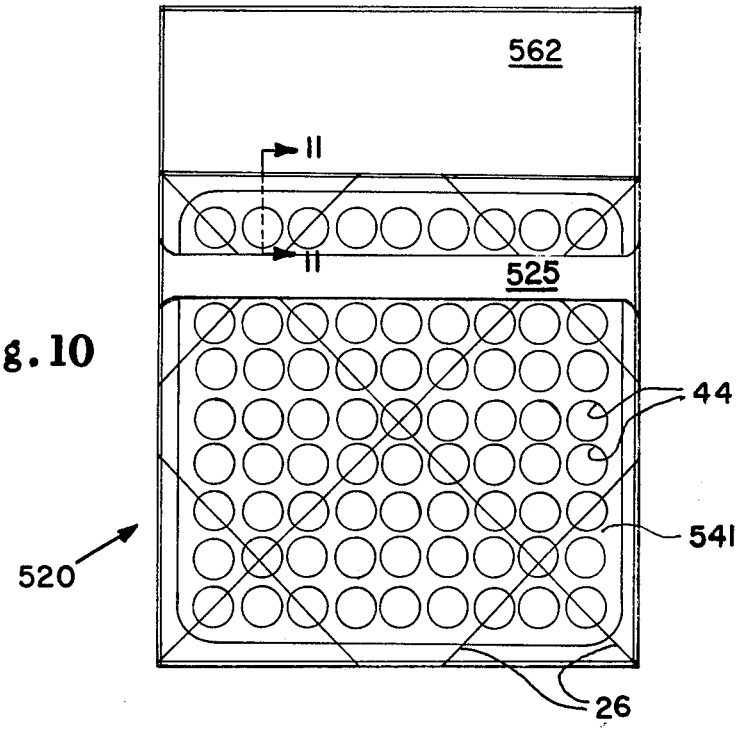
FIG. 10 is a frontal view of a relatively large size microwave energy cooking bag embodiment of the present invention.

FIG. 10 is a frontal view of an alternate bag 520 which embodies the present invention. Bag 520 is substantially identical to bag 20, FIG. 1, except it is somewhat smaller, does not have side gussets, and has only a back flap 562 rather than front and back flaps 61 and 62 of bag 20. For convenience, the portions of bag 520 which correspond to portions of bag 20 are identified by the same tens and units digits. For example, flap 562 of bag 520 corresponds to flap 62 of bag 20.

Sheets 541 (shown) and 542 (not visible in FIG. 10) of bag 520, FIG. 10, are perforated by identical arrays of nine rows of nine apertures 44 (total of eighty-one apertures 44) having the same diameter and spacing as in bag 20, FIG. 1. The overall nominal dimensions of bag 520 are about thirty-four (34) centimeters wide and about forty-five (45) centimeters long.

Figure 11:
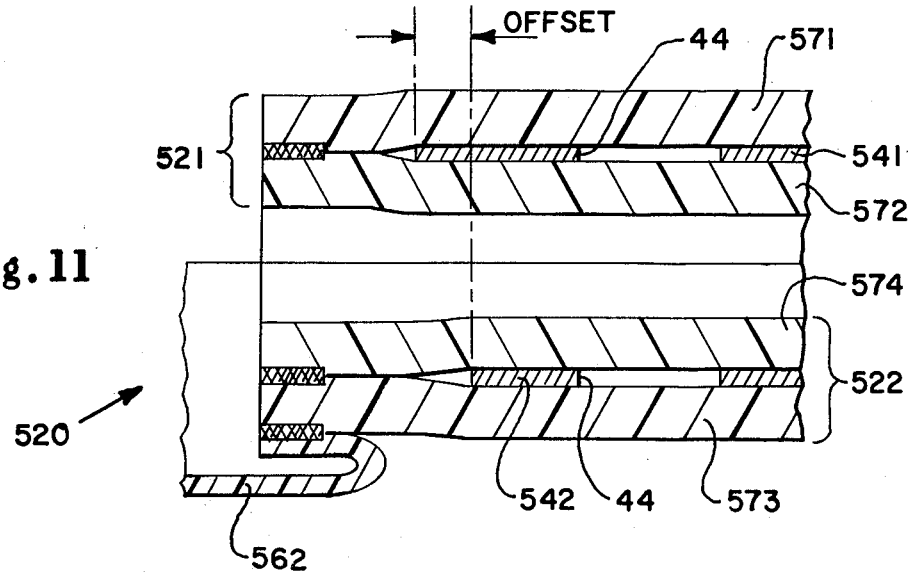
FIG. 11 is an enlarged scale fragmentary sectional view taken along line 11—11 of FIG. 10, and in which view thicknesses are greatly exaggerated for clarity.

FIG. 11 is an enlarged scale fragmentary sectional view taken along line 11—11 of FIG. 10. FIG. 11 shows the construction details in the region of bag 520 where the back flap 562 is secured to the three layer portion of back panel 522.

Figure 12:
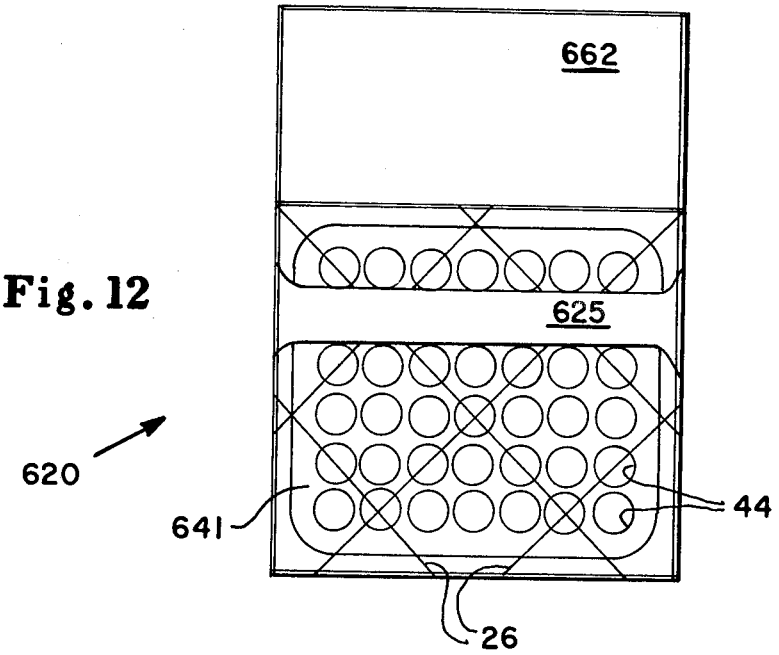
FIG. 12 is a frontal view of a relatively small size microwave energy cooking bag embodiment of the present invention.

FIG. 12 is a frontal view of another alternate bag 620 which embodies the present invention. Bag 620 is substantially identical to bag 520 but smaller. The designators for the portions of bag 620 which correspond to portions of bags 20 and 520 have identical tens and units digits for convenience in understanding.

Sheet 641, FIG. 12, and sheet 542 (not visible in FIG. 12) are perforated by identical arrays of six rows of seven apertures 44 (total of forty-two apertures 44) having the same diameter and spacing as bag 20 described hereinbefore. The overall nominal dimensions of bag 620 are about twenty-seven centimeters (27 cm.) wide and about thirty-nine centimeters (39 cm.) long.

Figure 13:
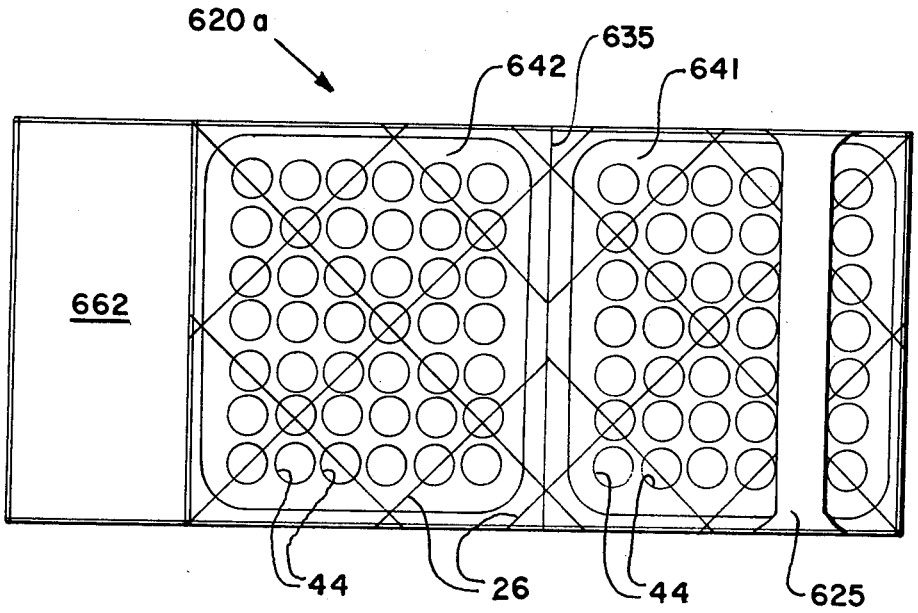
FIG. 13 is a plan view showing an intermediate state of construction of an alternate bag construction which is similar to the bag shown in FIG. 12.

FIG. 13 is a plan view of a bag subassembly **620*a* which embodies the present invention. However, whereas the previously described bags are described hereinbefore as comprising discrete front and back panels, the bag subassembly 620*a* is a single three-layer integrated panel having two conductive sheets 641 and 642 disposed between high bulk thermoplastic batts and secured therebetween by a quilt-like network of bar seals 26. A flap panel 662 is attached to one end of the three layer structure in the same manner as shown in FIG. 11, and a closure strap 625 is secured transverse the opposite end of the three layer structure. The bag subassembly 620*a* can be converted into a completed bag by U-folding it along transverse bar seal 635, and bar sealing the juxtaposed side edges together. When thus completed, this bag would be substantially identical to bag 620, FIG. 12**.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of this invention.

What is claimed is:

1. In an improved microwave energy cooking bag having microwave energy moderating wall portions which wall portions include electrically conductive sheet material which is substantially fully perforated with a multiplicity of apertures of predetermined sizes with respect to a predetermined nominal frequency of microwave energy and which sheet material has some face-to-face areas, and which bag includes means for substantially obviating electrical arcing intermediate adjacent said face-to-face areas of said electrically conductive sheet material, the improvement wherein said means comprises a relatively thick, relatively low density batt of a relatively low dielectric loss factor, relative high electric field strength electrically insulative material disposed intermediate said adjacent face-to-face areas of said electrically conductive sheet material.

2. The improved microwave energy cooking bag of claim 1 wherein said batt comprises foamed thermoplastic material having a cellular structure.

3. The improved microwave energy cooking bag of claim 1 wherein said batt comprises a nonwoven web of thermoplastic material.

4. The improved microwave energy cooking bag of claim 1 wherein said batt is sufficiently resilient with respect to its thickness and the thickness of said electrically conductive sheet material that sharply creasing and crumpling said electrically conductive sheet material is substantially precluded.

5. The improved microwave energy cooking bag of claim 1 further comprising another said batt, said other batt being so configured and disposed with respect to said electrically conductive sheet material that electrical arcing is substantially obviated intermediate said bag and adjacent electrically conductive material whereby electrical arcing is substantially obviated intermediate a microwave oven and a said bag disposed therein, and intermediate adjacent said bags disposed in the microwave oven.

6. The improved microwave energy cooking bag of claim 1 wherein said batt comprises a thermoplastic material selected from among the group comprising generic polyolefins, polypropylene, polyethylene, fluorocarbons, polyimids, polyesters, polysulfones, and polycarbonates.

7. The improved microwave energy cooking bag of claim 1 wherein said batt comprises material having a density of from about ten-thousandths gram per cubic centimeter (0.010 g./cc) to about fifteen-thousandths gram per cubic centimeter (0.015 g/cc).

8. The improved microwave energy cooking bag of claim 7 wherein said density is preferably about one-hundredth gram per cubic centimeter (0.01 g./cc) and said batt has a coefficient of surface friction of about one (1).

9. The improved microwave energy cooking bag of claim 1 wherein said insulative material is cellulosic.

* * * * *